US007443227B2

(12) United States Patent
Lin

(10) Patent No.: US 7,443,227 B2
(45) Date of Patent: Oct. 28, 2008

(54) ADJUSTING CIRCUIT

(75) Inventor: Yu-Tong Lin, Hsinchu Hsien (TW)

(73) Assignee: Phison Electronics Corp., Miaoli (TW)

( * ) Notice: Subject to any disclaimer, the term of this patent is extended or adjusted under 35 U.S.C. 154(b) by 38 days.

(21) Appl. No.: 11/468,301

(22) Filed: Aug. 30, 2006

(65) Prior Publication Data

US 2008/0054995 A1 Mar. 6, 2008

(51) Int. Cl.
*H01H 37/76* (2006.01)

(52) U.S. Cl. ..... 327/525; 327/539

(58) Field of Classification Search ..... 327/525, 327/539

See application file for complete search history.

(56) References Cited

U.S. PATENT DOCUMENTS 5,361,001 A * 11/1994 Stolfa ..... 327/530
5,450,030 A * 9/1995 Shin et al. ..... 327/525
5,767,732 A * 6/1998 Lee et al. ..... 327/525
5,838,076 A * 11/1998 Zarrabian et al. ..... 307/115
6,462,609 B2 * 10/2002 Hashimoto et al. ..... 327/525
6,801,079 B2 * 10/2004 Marotta et al. ..... 327/539

* cited by examiner

*Primary Examiner*—Jeffrey S Zweizig
(74) *Attorney, Agent, or Firm*—Jiang Chyun IP Office

(57) ABSTRACT

A programmable detection adjuster is disclosed. The programmable detection adjuster comprises a bandgap and an adjusting circuit. The bandgap comprises a power input terminal, a voltage output terminal, a main resistance and a plurality of resistors. The adjusting circuit comprises a plurality of adjusting resistors, a plurality of transistor switches, a logic controller and detection circuits; said adjusting resistors connected to the main resistance of the bandgap in series. The adjusting resistors are respectively connected to the transistor switch in parallel. The transistor switches are connected to the logic controller. The logic controller is respectively connected to the detection circuits. The detection circuit detects the corresponding resistances in the detection circuit and outputs a voltage level to the logic controller to enable the logic controller to control a conduction of the transistor switches according to a logic conversion table.

27 Claims, 8 Drawing Sheets

| Fuse States | | | Output voltage |
|---|---|---|---|
| TC↔TB (4R) | TB↔TA (2R) | TA↔GND (1R) | |
| Short | Short | Short | VBG-3△V |
| Short | Short | Open | VBG-2△V |
| Short | Open | Short | VBG-1△V |
| Short | Open | Open | VBG |
| Open | Short | Short | VBG+1△V |
| Open | Short | Open | VBG+2△V |
| Open | Open | Short | VBG+3△V |
| Open | Open | Open | VBG+4△V |

*PRIOR ART*
*FIG.2*

| Fuse States | | | Transferred logic (B2,B1,B0) | Output voltage |
|---|---|---|---|---|
| TC ↔ GND | TB ↔ GND | TA ↔ GND | | |
| Short | Short | Short | 100 | VBG |
| Short | Short | Open | 101 | VBG−1ΔV |
| Short | Open | Short | 110 | VBG−2ΔV |
| Short | Open | Open | 111 | VBG−3ΔV |
| Open | Short | Short | 011 | VBG+1ΔV |
| Open | Short | Open | 010 | VBG+2ΔV |
| Open | Open | Short | 001 | VBG+3ΔV |
| Open | Open | Open | 000 | VBG+4ΔV |

FIG. 3B

ADJUSTING CIRCUIT

BACKGROUND OF THE INVENTION

1. Field of Invention

The present invention relates to a bandgap circuit, more particularly to an adjusting circuit for adjusting a reference voltage outputted from the bandgap circuit.

2. Description of the Related Art

The trend of the semiconductor industry nowadays is heading towards design so that the integration of 3C (consumer, computer and communication products) and systems on chips (SOC) are most desirable. The purpose is to reduce the cost, increase efficiency and reduce power consumption, and also to develop lighter, thinner, shorter and smaller portable electronic devices, which may be possible by adopting a more precise design technology and a better process. The present chip unit can carry several chips, and integration of various elements is at a remarkable progress.

The chips on the circuit need a reference voltage generating circuit for generating a reference voltage; for example, the reference voltage is set based on the expectation of excellent temperature stability and a stable voltage supply. In other words, the setting of the reference voltage is required to be apart from external environment. However, the reference voltage generating circuit may result in voltage deviation due to different semiconductor process conditions. Therefore, for solving the issue of deviation, some manufacturers propose using a plurality of small resistors connected to a main resistor of the reference voltage generating circuit. Referring to FIGS. 1 and 2, a fine adjusting circuit B is connected to a main resistor A1 of the reference voltage generating circuit A, namely bandgap circuit. The fine adjusting circuit B comprises a plurality of resistors B1 connected to the main resistor A1 in series, and the resistors B1 are respectively connected to fuses B2 in parallel. Thus, the resistors B1 can fine adjust the value of the main resistor A1 according to the status of the fuses B2 connected to the resistors B1.

The above conventional reference voltage generating circuit A (bandgap circuit) has the following defects.

1. The conventional reference voltage generating circuit A can only burn out the fuses B2 but not add the fuses B2 after the chips are formed. Therefore, for fine adjusting the positive and the negative terminals, the fuses B2 should not be blown out before the chips are processed. Accordingly, an output voltage A2 (VBG) of the reference voltage generating circuit A is low, as shown in FIG. 2.

2. The conventional fuses B2 are blown out by the current, and when the current is controlled inappropriately, the reference voltage generating circuit A may get damaged.

3. In the above fine adjusting circuit B, the fuses B2 must be blown out in order to obtain a "0" or "1" signal. Therefore, the chips must be processed before packaged, or otherwise the "0" or "1" setup cannot precisely meet the requirement.

Therefore, how to overcome the conventional defects described above is an important issue for manufacturers in the field.

SUMMARY OF THE INVENTION

According to an aspect of the present invention, a logic controller in an adjusting circuit is used to control transistor switches to output an "on" or "off" signal to fine adjust a main resistor of a bandgap circuit. Thus, an output voltage of the bandgap circuit will not be lowered before the fine adjustment of the main resistor.

According to another aspect of the present invention, resistance values of a resistor and a fuse within a detection circuit are compared regardless of the fact that a fuse is blown out or not. Therefore, only the corresponding logic controller needs to be adjusted according to the requirement before manufacturing the adjusting circuit that can simplify the process of material preparation.

BRIEF DESCRIPTION OF THE DRAWING

FIG. 2 is a voltage output table of a conventional bandgap circuit.

DETAILED DESCRIPTION OF THE INVENTION

Figure 1:
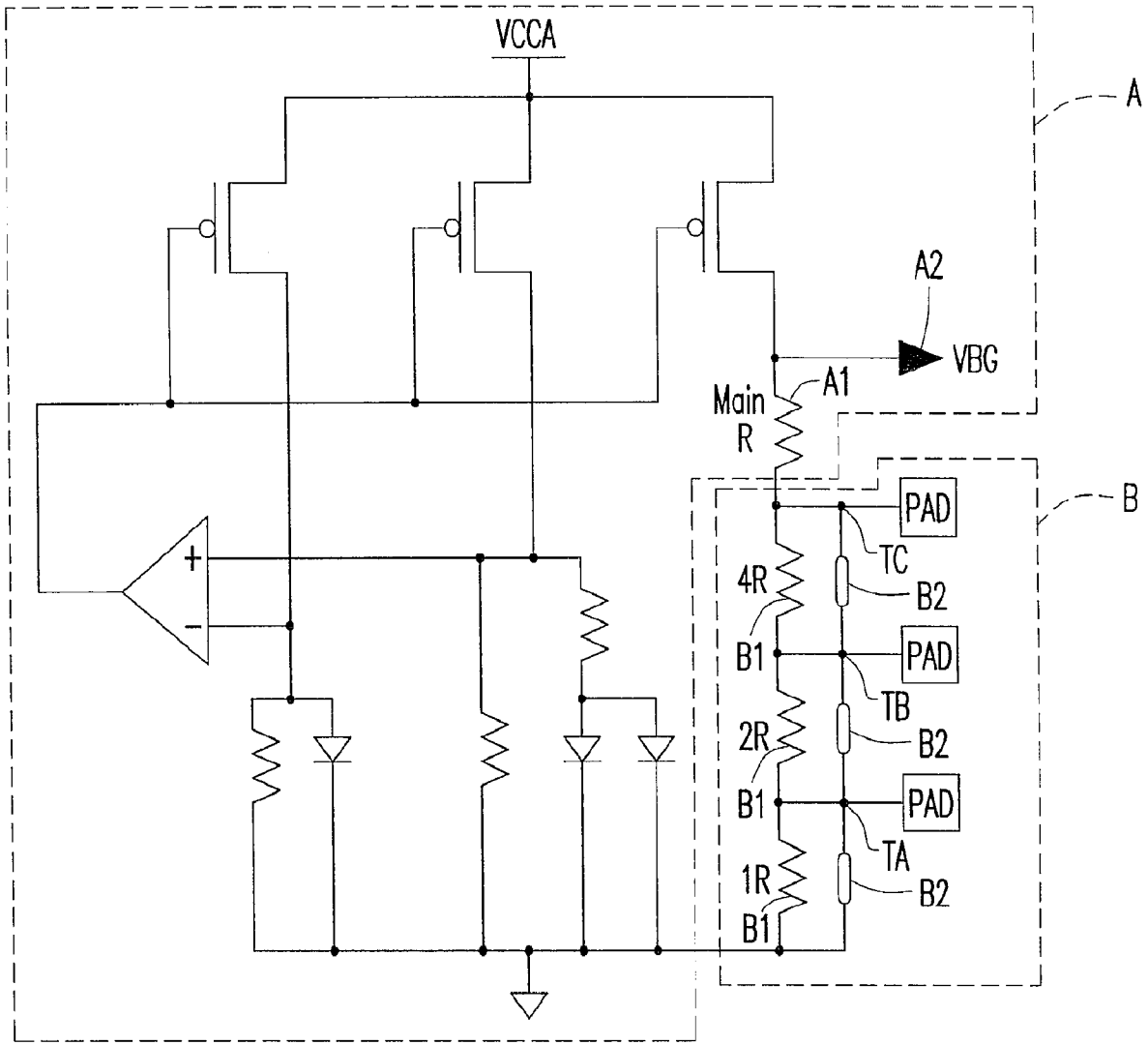
FIG. 1 (PRIOR ART)
FIG. 1 is a block diagram of a conventional bandgap circuit.
Figure 3:
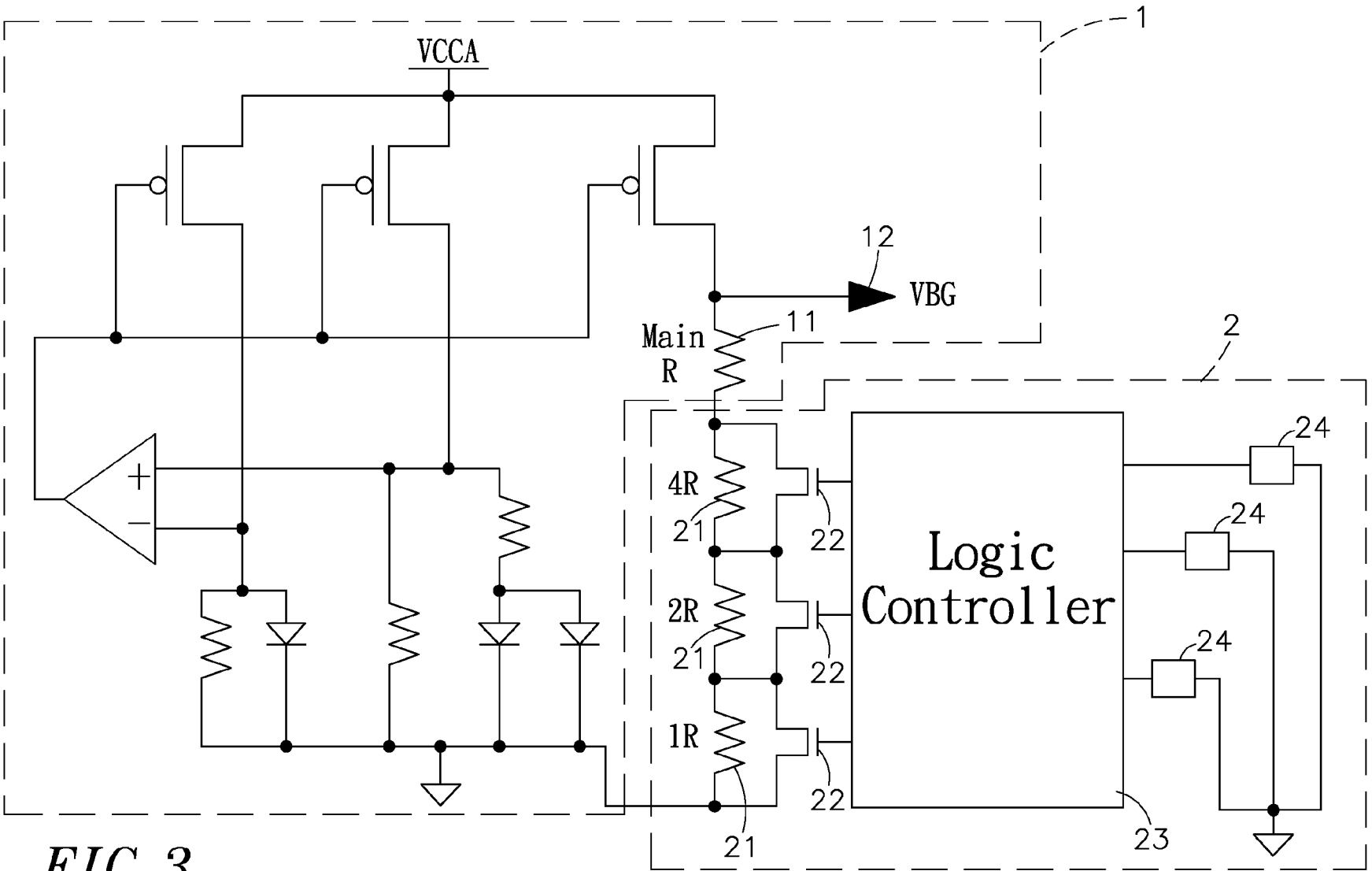
FIG. 3A is a circuit diagram of a bandgap circuit according to an embodiment of the present invention.
FIG. 3B is a diagram of a logic conversion table according to an embodiment of the present invention.
Figure 3A:
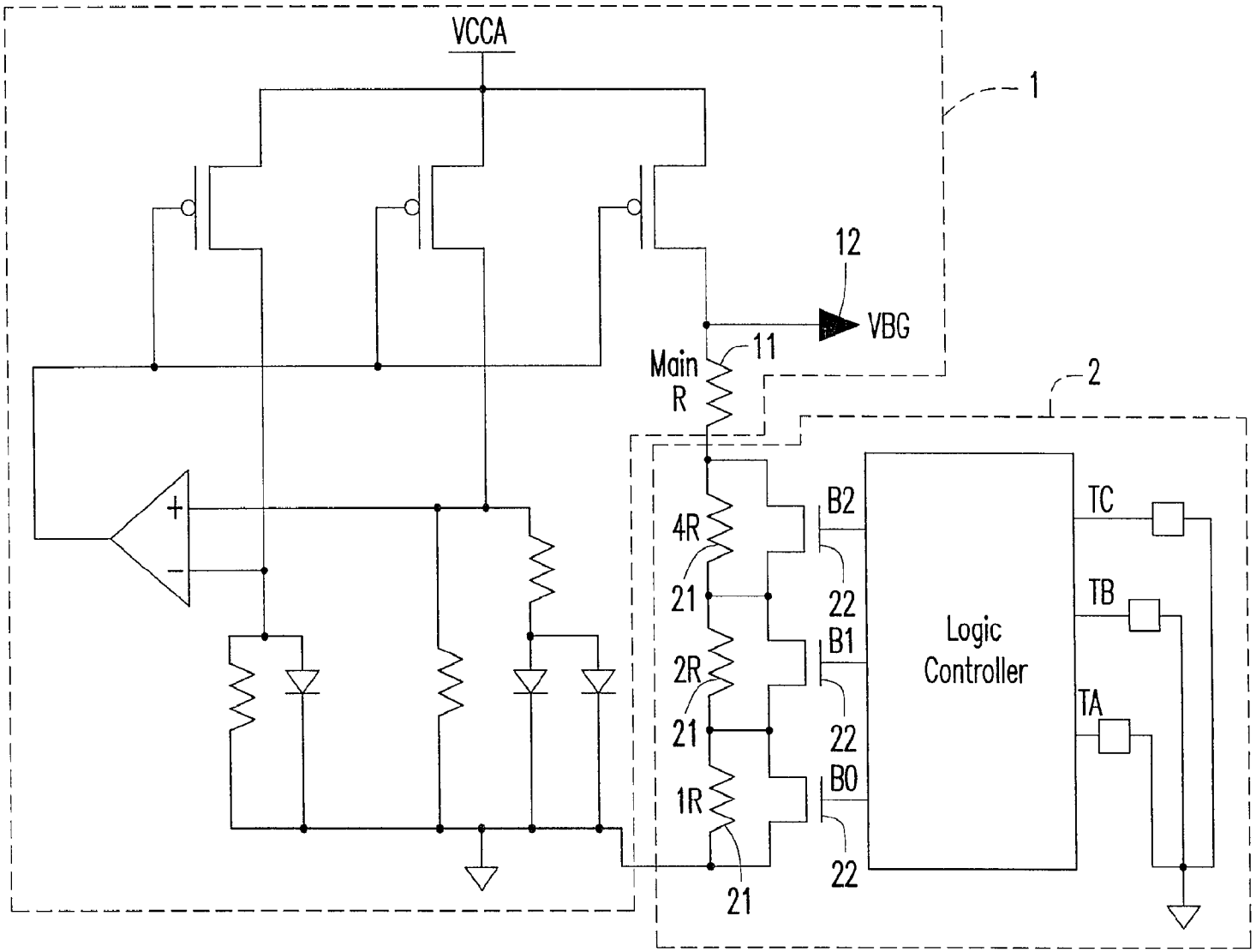

FIG. 3 is a circuit diagram of a bandgap circuit according to an embodiment of the present invention. Referring to FIG. 3, the bandgap circuit 1 comprises a main resistor 11 connected to an adjusting circuit 2. The adjusting circuit 2 comprises a plurality of adjusting resistors 21 connected to the main resistor 11 in series. Each adjusting resistor 21 is connected to a transistor switch 22 in parallel, wherein the transistor switches 22 are connected to a logic controller 23. The logic controller 23 is connected to a plurality of detection circuits 24 in an orderly manner, and the number of the detection circuits 24 is the same as the number of the transistor switches 22.

Figure 4:
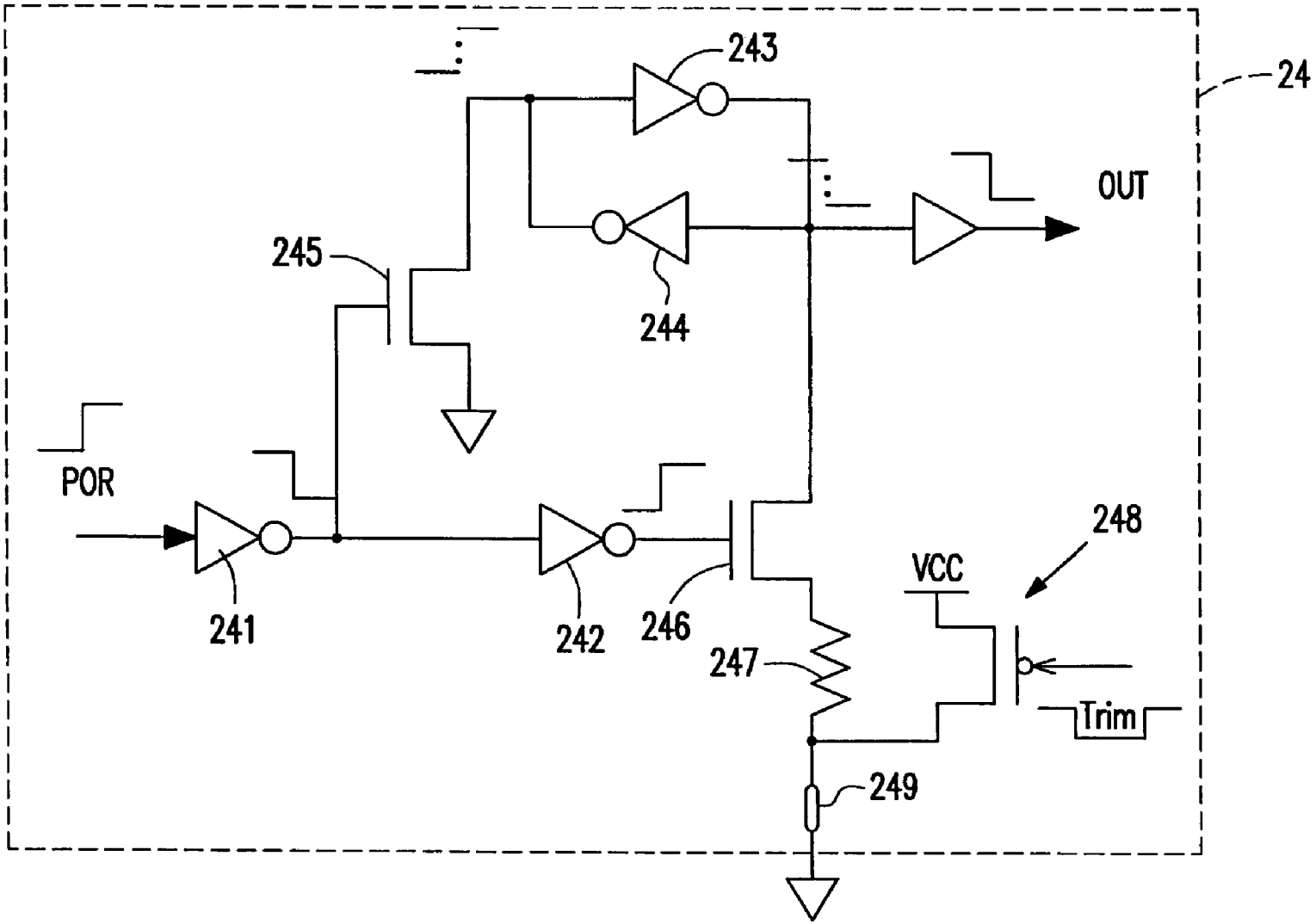
FIG. 4 is a circuit diagram of an adjusting circuit according to a first embodiment of the present invention.

FIG. 4 is a circuit diagram of an adjusting circuit according to a first embodiment of the present invention. Referring to FIGS. 3 and 4, when an output voltage (VBG) 12 from the bandgap circuit 1 is fine adjusted by the adjusting circuit 2, every detection circuit 24 detects whether or not a fuse 249 is blown out and whether or not a large current flows through the fuse 249 from a third transistor switch 248. If the fuse 249 is blown out, the detection circuits 24 output a high level voltage detection signal to the logic controller 23; otherwise, the detection circuits 24 output a low level voltage detection signal to the logic controller 23. Besides, whether or not to blow out the fuse 249 depends upon the on/off status of the third transistor switch 248; however, the current flowing through the fuse 249 is limited by the third transistor switch 248, wherein if the current is not sufficient to blow out the fuse 249, the detection circuit 24 shown in FIG. 5 judges the relationship between a resistance value of a resistor R and a resistance value of the fuse 249 in the detection circuit 24 to decide to output the low level voltage detection signal or the high level voltage detection signal to the logic controller 23. Thus, the output of the bandgap circuit 1 is not affected regardless whether or not the fuse 249 is blown out.

When the logic controller 23 receives the detection signals from the detection circuits 24, the logic controller 23 will convert the detection signals according to a logic conversion table to control whether the transistor switches 22 are conducted or not. Thus, the main resistor 11 of the bandgap circuit 1 can fine adjust the value of the main resistor 11 by using the adjusting resistors 21. Accordingly, the logic controller 23 uses logic conversion table shown in FIG. 3B to adjust on/off of the transistor switches 22 before a chip is processed to avoid the output voltage 12 of the bandgap circuit 1 from being overly low while the chip is never processed with all the fuses.

Furthermore, the transistor switches 22, a first transistor switch 245, a second transistor switch 246 and the third transistor switch 248 of the present invention may be comprised of NMOS, PMOS or any device with equivalent functionality to achieve the purpose of the present invention, and thus modifications of the transistor switches shall also be construed to be within the scope of the present invention.

Referring to FIGS. 3 and 4, the detection circuit 24 comprises a first inverter 241. An input terminal of the first inverter 241 is used for receiving a power-on reset (POR) signal, and an output terminal of the first inverter 241 is connected to an input terminal of a second inverter 242 and a gate of the first transistor switch 245. A drain of the first transistor switch 245 is respectively connected to an input terminal of a third inverter 243 and an output terminal of a fourth inverter 244, and a source of the first transistor switch 245 is connected to a ground. An output terminal of the second inverter 242 is connected to a gate of the second transistor switch 246, and a drain of the second transistor switch 246 is respectively connected to an output terminal of the third inverter 243 and an input terminal of the fourth inverter 244. A source of the second transistor switch 246 is connected to one terminal of the resistor 247, and the other terminal of the resistor 247 is connected to a drain of the third transistor switch 248 and one terminal of the fuse 249. The other terminal of the fuse 249 is connected to the ground. A source of the third transistor switch 248 is connected to a power supply VCC, and a gate of the third transistor switch 248 is used for receiving a trim signal Trim. When it is determined that the fuse 249 is not blown out, as shown in FIG. 4, the detection circuit 24 outputs a low level voltage to the logic controller 23 and then the logic controller 23 to switch on or off the corresponding transistor switches 22 according to a logic conversion system together with the corresponding detection signals in order to control whether the transistor switches 22 are conducted or not. Thus, the main resistor 11 of the bandgap circuit 1 can fine adjust the value of the main resistor 11 by using the adjusting resistors 21.

Figure 5:
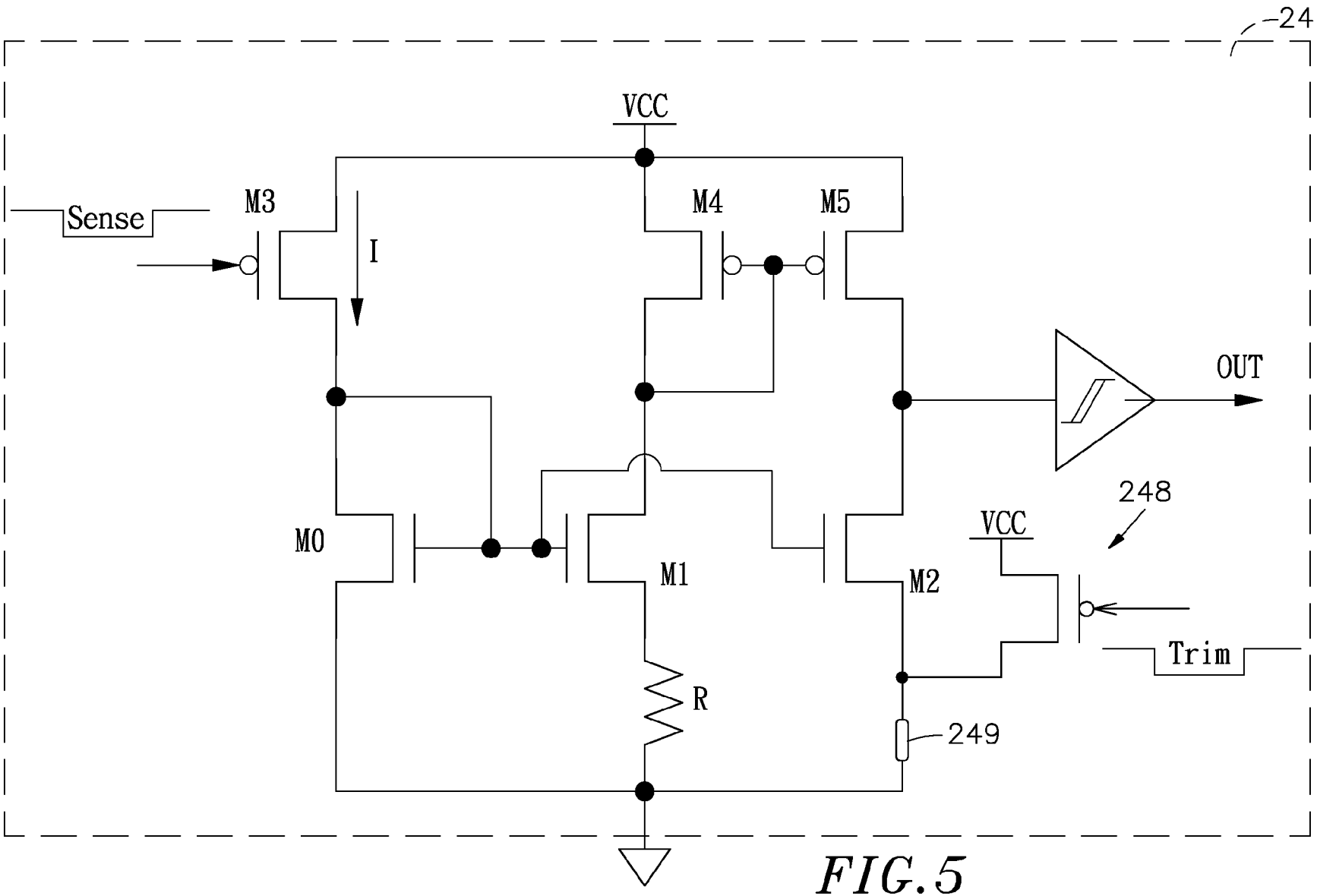
FIG. 5 is a circuit diagram of an adjusting circuit according to a second embodiment of the present invention.
Figure 6:
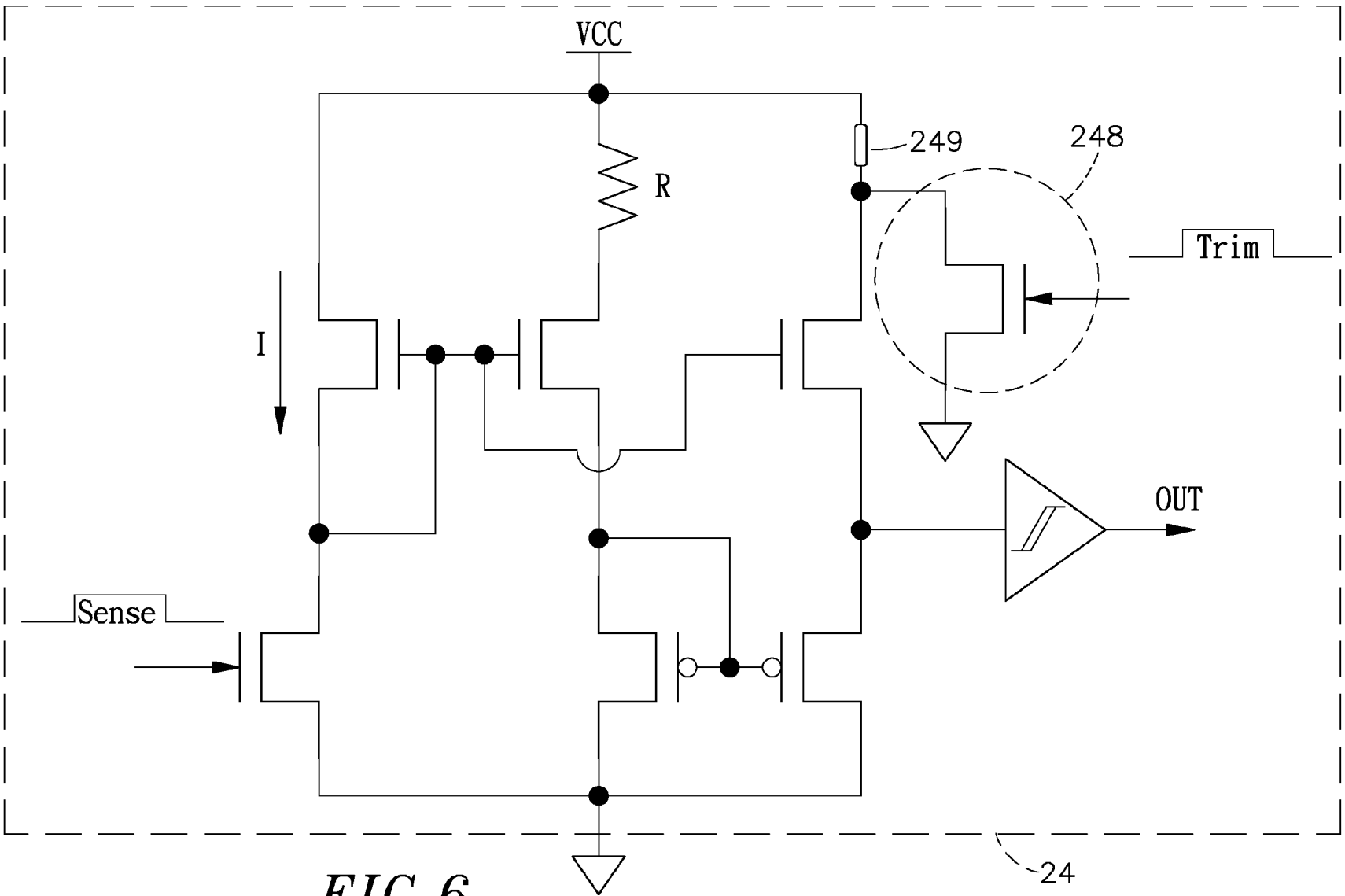
FIG. 6 is a circuit diagram of an adjusting circuit according to a third embodiment of the present invention.

FIG. 5 is a circuit diagram of an adjusting circuit according to a second embodiment of the present invention. Referring to FIGS. 3 and 5, because a gate of the transistor switch M3 is used for receiving a sense signal which is kept on low level, so that when the detection circuit 24 detects a large current flowing through M3, and if the resistance value of the fuse 249 is smaller than the resistance value of the resistor R, the current flowing through M2 is larger than the current flowing through M1, and the current from M1 flows through the current gain of M4 to M5. Therefore, the current of M5 is smaller than that of M2, and thus the detection circuit 24 outputs "0" or the "off" signal. On the other hand, if the resistance value of the fuse 249 is larger than the resistance R, the detection circuit 24 outputs "1" or the "on" signal. Furthermore, FIG. 6 is a circuit diagram of an adjusting circuit according to a third embodiment of the present invention, referring to FIG. 6, the functionality of the detection circuit 24 in FIG. 6 is similar to the functionality of the detection circuit 24 in FIG. 5, so that one skilled in the art should be understood the operation of the detection circuit 24 in FIG. 6 by referring the detection circuit 24 in FIG. 5, and thus the details for the detection circuit 24 in FIG. 6 are omitted herein.

Accordingly, the adjusting circuit 2 of the present invention has the following advantages.

1. The adjusting circuit 2 of the present invention has a plurality of the adjusting resistors 21 connected in series to the main resistor 11 of the bandgap circuit 1, and the adjusting resistors 21 are connected to the transistor switches 22 in parallel. The transistor switches 22 are also connected to the logic controller 23, and when the logic controller 23 receives the detection signals from the detection circuit 24, the logic controller 23 outputs the "0" or "1" signal to the corresponding transistor switches 22 according to the logic conversion table to control the conduction of the transistor switches 22, and also enables the main resistor 11 of the bandgap circuit 1 to fine adjust the value thereof by using the adjusting resistors 21 of the adjusting circuit 2 to prevent the bandgap circuit 1 from outputting the overly low voltage.

2. The detection circuit 24 of the present invention detects whether or not the fuse 249 is blown out and compares the relationship between the resistance values of the resistor R and the fuse 249 for outputting the detection signals to the logic controller 23 to enable the logic controller 23 to control the conduction of the transistor switches 22. Furthermore, when the fuse 249 is blown out, because the detection circuit 24 is not directly connected to the bandgap circuit 1, the current burning out the fuse 249 can be controlled, and the bandgap circuit 1 will not be damaged.

3. The detection circuit 24 and the logic controller 23 of the present invention is used to fine adjust the value of the main resistor 11 of the bandgap circuit 1, and thus the number of PAD need not be increased and thereby avoid any additional space occupation.

4. The detection circuit 24 of the present invention is used to inspect the resistance values of the resistor R and the fuse 249. Thus, the logic controller 23 can accurately judge if the "on" or "off" signal is outputted to the transistor switch 22 according to the status of the fuse 249 in the detection circuit 24. Accordingly, if the resistance value of the fuse 249 in the detection circuit 24 is increased, the need of the user can be satisfied in a way to solve the problem of the material preparation.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What the invention claimed is:

1. An adjusting circuit, for adjusting a reference voltage outputted from an output terminal of a bandgap circuit, the bandgap circuit comprising a main resistor, wherein a first terminal of the main resistor is coupled to the output terminal of the bandgap circuit, a second terminal of the main resistor is coupled to a ground through the adjusting circuit, the adjusting circuit comprising:

a plurality of adjusting resistors, coupled in series between the second terminal of the main resistor and the ground;

a plurality of first switches, wherein the ith first switch corresponds to the ith adjusting resistor, and the ith first switch couples the ith adjusting resistor in parallel, where i is a positive integer;

a plurality of detection circuits, wherein the ith detection circuit corresponds to the ith first switch for generating a detection signal by detecting whether a fuse within the ith detection circuit is blown out or not, or comparing a relationship between a current flowing through the fuse and a current flowing through a resistor within the ith detection circuit; and a logic controller, coupled to the first switches and the detection circuits, for controlling whether the first switches are conducted or not by finding a combination of the detection signals generated from the detection circuits in a logic conversion table.

2. The adjusting circuit according to claim 1, wherein the first switches are an NMOS transistor.

3. The adjusting circuit according to claim 2, wherein a first and a second terminals of the ith first switch are coupled to the ith adjusting resistor in parallel, and a third terminal of the ith first switch is coupled to the logic controller, wherein the first terminal of the first switch is a drain, the second terminal of the first switch is a source and the third terminal of the first switch is a gate.

4. The adjusting circuit according to claim 2, wherein each detection circuit further comprises:

a first inverter, wherein an input terminal of the first inverter is used for receiving a power-on reset (POR) signal;

a second inverter, wherein an input terminal of the second inverter is coupled to an output terminal of the first inverter;

a second switch, wherein a first terminal of the second switch is coupled to the output terminal of the first inverter, and a second terminal of the second switch is coupled to the ground;

a third inverter, wherein an input terminal of the third inverter is coupled to a third terminal of the second switch;

a fourth inverter, wherein an input terminal of the fourth inverter is coupled to an output terminal of the third inverter, and an output terminal of the fourth inverter is coupled to the input terminal of the third inverter;

a third switch, wherein a first terminal of the third switch is coupled to an output terminal of the second inverter, a second terminal of the third switch is coupled to the input terminal of the fourth inverter, and a third terminal of the third switch is coupled to a first terminal of the resistor;

a buffer, wherein an input terminal of the buffer is coupled to the input terminal of the fourth inverter, and an output terminal of the buffer is coupled to the logic controller for outputting the detection signal; and a fourth switch, wherein a first terminal of the fourth transistor is used for receiving a trim signal, a second terminal of the fourth switch is coupled to a power supply, a third terminal of the fourth switch is coupled to a first terminal of the fuse and a second terminal of the resistor, and a second terminal of the fuse is coupled to the ground.

5. The adjusting circuit according to claim 4, wherein the second switch and the third switch are NMOS transistors and the fourth switch is a PMOS transistor.

6. The adjusting circuit according to claim 5, wherein the first terminal of the second switch is a gate, the second terminal of the second switch is a source and the third terminal of the second switch is a drain.

7. The adjusting circuit according to claim 5, wherein the first terminal of the third switch is a gate, the second terminal of the third switch is a drain and the third terminal of the third switch is a source.

8. The adjusting circuit according to claim 5, wherein the first terminal of the fourth switch is a gate, the second terminal of the fourth switch is a source and third terminal of the fourth switch is a drain.

9. The adjusting circuit according to claim 2, wherein each detection circuit further comprises:

a second switch, wherein a first terminal of the second switch is used for receiving a sense signal, and a second terminal of the second switch is coupled to a power supply;

a third switch, wherein a first terminal and a second terminal of the third switch is coupled to a third terminal of the second switch, and a third terminal of the third switch is coupled to the ground;

a fourth switch, wherein a first terminal of the fourth switch is coupled to the first terminal of the third switch, a second terminal of the fourth switch is coupled to a first terminal of the resistor, and a second terminal of the resistor is coupled to the ground;

a fifth switch, wherein a first terminal of the fifth transistor is coupled to the power supply, and a second terminal and a third terminal of the fifth switch is coupled to a third terminal of the fourth switch;

a sixth switch, wherein a first terminal of the sixth switch is coupled to the power supply, and a second terminal of the sixth switch is coupled to the second terminal of the fifth switch;

a seventh switch, wherein a first terminal of the seventh switch is coupled to the first terminal of the third switch, a second terminal of the seventh switch is coupled to a third terminal of the sixth switch, a third terminal of the seventh switch is coupled to a first terminal of the fuse, and a second terminal of the fuse is coupled to the ground;

a buffer, wherein an input terminal of the buffer is coupled to the second terminal of the seventh switch, and an output terminal of the buffer is coupled to the logic controller for outputting the detection signal; and a eighth switch, wherein a first terminal of the eighth switch is coupled to the power supply, a second terminal of the eighth switch is used for receiving a trim signal, and a third terminal of the eighth switch is coupled to the first terminal of the fuse.

10. The adjusting circuit according to claim 9, wherein the second switch, the fifth switch, the sixth switch and the eighth switch are PMOS transistors and the third switch, the fourth switch and seventh switch are NMOS transistors.

11. The adjusting circuit according to claim 10, wherein the first terminal of the second switch is a gate, the second terminal of the second switch is a source and the third terminal of the second switch is a drain.

12. The adjusting circuit according to claim 10, wherein the first terminal of the third switch is a gate, the second terminal of the third switch is a drain and the third terminal of the third switch is a source.

13. The adjusting circuit according to claim 10, wherein the first terminal of the fourth switch is a gate, the second terminal of the fourth switch is a source and the third terminal of the fourth switch is a drain.

14. The adjusting circuit according to claim 10, wherein the first terminal of the fifth switch is a source, the second terminal of the fifth switch is a gate and the third terminal of the fifth switch is a drain.

15. The adjusting circuit according to claim 10, wherein the first terminal of the sixth switch is a source, the second terminal of the sixth switch is a gate and the third terminal of the sixth switch is a drain.

16. The adjusting circuit according to claim 10, wherein the first terminal of the seventh switch is a gate, the second terminal of the seventh switch is a drain and the third terminal of the seventh switch is a source.

17. The adjusting circuit according to claim 10, wherein the first terminal of the eighth switch is a source, the second terminal of the eighth switch is a gate and the third terminal of the eighth switch is a drain.

18. The adjusting circuit according to claim 2, wherein each detection circuit further comprises:

a second switch, wherein a first terminal of the second transistor is used for receiving a sense signal, and a second of the second switch is coupled to the ground;

a third switch, wherein a first terminal of the third switch is coupled to a power supply, a first terminal of the resistor and a first terminal of the fuse, a second terminal and a third terminal of the third switch is coupled to a third terminal of the second switch;

a fourth switch, wherein a first terminal of the fourth transistor is coupled to a second terminal of the resistor, a second terminal of the fourth transistor is coupled to the second terminal of the third switch;

a fifth switch, wherein a first terminal and a second terminal of the fifth switch is coupled to a third terminal of the fourth transistor, and a third terminal of the fifth switch is coupled to the ground;

a sixth switch, wherein a first terminal of the sixth switch is coupled to the second terminal of the third switch, and a second terminal of the sixth switch is coupled to a second terminal of the fuse;

a seventh switch, wherein a first terminal of the seventh switch is coupled to the second terminal of the fifth switch, a second terminal of the seventh switch is coupled to a third terminal of the sixth switch, and a third terminal of the seventh transistor is coupled to the ground;

a eighth switch, wherein a first terminal of the eighth switch is used for receiving a trim signal, a second terminal of the eighth switch is coupled to the second terminal of the fuse, and a third terminal of the eighth switch is coupled to the ground; and a buffer, wherein an input terminal of the buffer is coupled to the second terminal of the seventh switch, and an output terminal of the buffer is coupled to the logic controller for outputting the detection signal.

19. The adjusting circuit according to claim 18, wherein the second switch, the third switch, the fourth switch, the sixth switch and the eighth switch are NMOS transistors and the fifth switch and the seventh switch are PMOS transistors.

20. The adjusting circuit according to claim 19, wherein the first terminal of the second switch is a gate, the second terminal of the second switch is a source and the third terminal of the second switch is a drain.

21. The adjusting circuit according to claim 19, wherein the first terminal of the third switch is a drain, the second terminal of the third switch is a gate and the third terminal of the third switch is a source.

22. The adjusting circuit according to claim 19, wherein the first terminal of the fourth switch is a drain, the second terminal of the fourth switch is a gate and the third terminal of the fourth switch is a source.

23. The adjusting circuit according to claim 19, wherein the first terminal of the fifth switch is a source, the second terminal of the fifth switch is a gate and the third terminal of the fifth switch is a drain.

24. The adjusting circuit according to claim 19, wherein the first terminal of the sixth switch is a gate, the second terminal of the sixth switch is a drain and the third terminal of the sixth switch is a source.

25. The adjusting circuit according to claim 19, wherein the first terminal of the seventh switch is a gate, the second terminal of the seventh switch is a source and the third terminal of the seventh switch is a drain.

26. The adjusting circuit according to claim 19, wherein the first terminal of the eighth switch is a gate, the second terminal of the eighth switch is a drain and the third terminal of the eighth switch is a source.

27. The adjusting circuit according to claim 1, wherein if the current flowing through the fuse is smaller than the current flowing through the resistor, the ith detection circuit outputs "0" or "off" signal; whereas if the current flowing through the fuse is larger than the current flowing through the resistor, the ith detection circuit outputs "1" or "on" signal".

* * * * *